US007810960B1

(12) United States Patent
Soderman et al.

(10) Patent No.: US 7,810,960 B1
(45) **Date of Patent: *Oct. 12, 2010**

(54) LIGHT FIXTURE ASSEMBLY HAVING IMPROVED HEAT DISSIPATION CAPABILITIES

(75) Inventors: Daryl Soderman, Fort Lauderdale, FL (US); Dale B. Stepps, Yucca Valley, CA (US)

(73) Assignee: Inteltech Corporation, Fort Lauderdale, FL (US)

( * ) Notice: Subject to any disclaimer, the term of this patent is extended or adjusted under 35 U.S.C. 154(b) by 191 days.

This patent is subject to a terminal disclaimer.

(21) Appl. No.: 12/215,047

(22) Filed: Jun. 24, 2008

Related U.S. Application Data

(63) Continuation-in-part of application No. 11/985,056, filed on Nov. 13, 2007.

(51) Int. Cl.
*F21V 29/00* (2006.01)

(52) U.S. Cl. ..... 362/294; 362/249.02; 362/373

(58) Field of Classification Search ..... 362/249.01, 362/249.02, 145, 404, 373, 294
See application file for complete search history.

(56) References Cited

U.S. PATENT DOCUMENTS 5,738,436 A * 4/1998 Cummings et al. ..... 362/294
6,388,388 B1 5/2002 Weindorf et al.
6,472,828 B1 10/2002 Pruett et al.
6,642,674 B2 11/2003 Liao et al.
7,183,727 B2 2/2007 Ferguson et al.
7,186,000 B2 3/2007 Lebens et al.
7,252,385 B2 8/2007 Engle et al.
7,329,024 B2 * 2/2008 Lynch et al. ..... 362/240
2005/0213047 A1 9/2005 Slobodin et al.
2006/0126328 A1 * 6/2006 Coushaine ..... 362/247

* cited by examiner

*Primary Examiner*—John A Ward
(74) *Attorney, Agent, or Firm*—Malloy & Malloy, P.A.

(57) ABSTRACT

A light fixture assembly including an illumination assembly in the form of one or more light emitting diodes is interconnected to an electrical energy source by control circuitry. A mounting assembly supports the illumination assembly and a cover structure is disposed in heat transferring relation to the illumination assembly, wherein the cover structure, which has an enlarged surface area formed of a heat conductive material, defines a decorative exterior of the light fixture and is disposed exterior of a mounting surface, thereby effectively dissipating the heat generated by the LED illumination assembly towards the environment being illuminated by the light fixture.

15 Claims, 5 Drawing Sheets

LIGHT FIXTURE ASSEMBLY HAVING IMPROVED HEAT DISSIPATION CAPABILITIES

CLAIM OF PRIORITY

The present application is a continuation-in-part application of previously filed, now pending application having Ser. No. 11/985,056, filed on Nov. 13, 2007 incorporated herein in its entirety by reference.

BACKGROUND OF THE INVENTION

1. Field of the Invention

This invention is directed to a flush or recess mounted light fixture assembly comprising an illumination assembly incorporating a light emitting diode (LED) array and a heat sink which is configured and disposed to efficiently dissipate heat by radiation rather than merely by conductivity, so as to maximize the appearance and illumination qualities of the light fixture and substantially diminish power limitations that result from limitations in heat dissipation.

2. Description of the Related Art

Various types of illumination assemblies which incorporate light emitting diodes (LED) as the light generating component have become increasingly popular in recent years. Such an increase in popularity is due, at least in part, to their overall efficiency as well as the ability to define various lighting arrays readily adaptable to numerous practical installations or applications.

Accordingly, LEDs are known for use in high power applications such as spotlights, automotive headlights, etc. However, due to their recognized versatility LEDs are also utilized extensively in various types of luminaires and/or like fixtures installed in conventional domestic and commercial environments. Such applications allow for the illumination of a given area in an efficient and variably decorative manner in that associated light fixtures may take the form of standard or customized lighting arrays, wall or ceiling mounted fixtures, inset lighting, etc. Further, LEDs provide increased energy efficiency and effective illumination output from the various types of light fixtures installed, while reducing maintenance costs associated therewith.

Therefore, the use of illumination assemblies incorporating collective LED arrays offer significant advantages in terms of increased lighting and efficiency of operation. However, certain disadvantages and problems associated with the use of LED based illumination assemblies are commonly recognized. More specifically, a primary concern with the structuring and use of LED illumination assemblies is the management or dissipation of excessive heat generated by the LED array. More specifically, the light intensity generated by an LED light source is generally a proportional function of its operational temperature. As such, LED illumination assemblies tend to generate a significant amount of heat during their operation, which in turn may derogatorily affect the light generated by the LED array as well as reduce the reliability and operational life thereof. Accordingly, the operable life of many LED based illumination assemblies may be significantly reduced due to premature failure of one or more light emitting diodes associated with a light fixture or other device, and/or the maximization of power and illuminating output for such an illumination assembly is limited.

Therefore, it is commonly recognized in the lighting industry that heat management and more specifically, heat dissipation is a critical structural and operational consideration in the manufacture, use, installation and overall viability of illumination assemblies incorporating light emitting diodes as the primary or exclusive light generating structure. Known attempts to overcome the problems associated with the generation of excessive heat involve the creation of diverse heat dissipating structures. By way of example, printed circuit boards have been disposed in a multi-layered or stacked array in attempt to transfer heat away from the LED array. Alternatively, one or more printed circuit boards associated with the operational control of the LED light generating structures include a metal core disposed and structured to further effect heat dissipation.

Other known or conventionally proposed solutions to the heat management problem include the utilization of a heat absorber including a heat conductive resin disposed in communicating relation with the circuitry of the LED array. Also, heat absorbing structures may be utilized which have a large physical configuration such as, but not limited to, a multi-finned structure providing a conductive path of heat transfer towards an area of dissipation. However, many known attempts do not effectively accomplish optimal heat transfer, resulting in lower operational performance and a reduced operational life as generally set forth above.

Accordingly, there is a long recognized need in the lighting industry for an efficient and practical heat dissipation assembly preferably of the type which may be easily included in the structure of a light fixture. Moreover, there is especially a need as it relates to recessed or flush lighting wherein traditional heat dissipating structures are hampered by being contained within a wall or other mounting surface. Specifically, known recessed or flush mounting structure typically include large unattractive heat sinks contained within the mounting surface and/or otherwise concealed. Because of their concealed positioning, these heat sinks rely on heat conduction to draw heat away from the light source, and thus are constructed so as to maximize their surface area within a contained location through the use of large numbers of vanes and ridges. Even then, however, there are limitations on the power and illumination ability of the light source, as there are usually space and weight constraints for the recessed heat sink, especially in the context of a retrofit wherein the cavity into which the light source will be positioned has been predefined based upon conventional incandescent lighting specifications.

Thus, it would be beneficial to provide an improved illumination assembly that would allow the light fixture to assume any number of design configurations best suited to the aesthetic and illumination requirements of a specific application without being hampered or limited by the heat dissipation requirements. It would also be beneficial to provide an illuminations assembly that has significant heat dissipating capabilities and is lot limited by space constraints within a mounting surface so as to be capable of an optimal level of light generation, while at the same time enjoying an extended operational life. Also, such an improved proposed light fixture should also include structural components which serve to effectively isolate or segregate the conductive material components associated with heat dissipation from direct contact with any type of electrical conductor.

Therefore, the proposed light fixture assembly would accomplish effective heat dissipation from an LED based illumination assembly, while at the same time assuring operational safety. Further, the proposed light fixture would be capable of sufficient structural and operational versatility to permit the light fixture to assume any of a variety of utilitarian and aesthetic configurations and would not need to sacrifice light emitting capabilities due to overheating.

SUMMARY OF THE INVENTION

The present invention is directed a light fixture assembly structured to include efficient heat dissipating capabilities and effective isolation of the conductive material components associated with the heat dissipating capabilities, from electrical components which serve to interconnect an illumination assembly with a source of electrical energy. Accordingly, the light fixture assembly of the present invention may be utilized for a variety of practical applications including installations within commercial, domestic, and specialized environments.

More specifically, the light fixture assembly of the present invention includes an illumination assembly including a light generating structure in the form of a light emitting diode (LED) array. As such, the light generating structure can comprise at least one or alternatively a plurality of LEDs. Moreover, each of the one or more LEDs is operatively interconnected to control circuitry which serves to regulate the operation and activation thereof. In at least one preferred embodiment of the present invention, the control circuitry is in the form of a printed circuit structure electrically interconnected to the one or more LEDs. Further, the light fixture assembly of the present invention includes a conductor assembly disposed in interconnecting, current conducting relation between the illumination assembly and an appropriate source of electrical energy, as generally set forth above.

In the category of LED based light generating structures, thermal management and more specifically, the dissipation of excessive heat generated from the LED array is a consideration. Adequate heat dissipation allows for optimal operative efficiency of the LED array as well as facilitating a long, operable life thereof. Accordingly, the light fixture assembly of the present invention uniquely accomplishes effective heat dissipation utilizing light fixture components which serve the normal structural, operational and decorative purpose of the light fixture assembly, while also transferring heat from the illumination assembly to the surrounding environment.

Concurrently, the aforementioned components of the light fixture may enhance the overall decorative or aesthetic appearance of the light fixture assembly while being dimensioned and configured to adapt the installation of the light fixture assembly to any of a variety of locations. As such, the light fixture assembly of the present invention includes a mounting assembly connected in supporting engagement with the illumination assembly. The mounting assembly can be formed entirely or partially of a conductive material disposed and structured to dissipate heat away from the illumination assembly, and/or may include a housing and other components to support an contain the illumination assembly.

In order to provide sufficient heat dissipating characteristics, the light fixture assembly of the present invention also includes a cover structure. The cover structure can serve to at least partially engage the mounting assembly and/or be integrally formed therewith. In this manner, effective channeling or directing of light generated by the one or more LEDs is directed outwardly from the cover structure, so as to properly illuminate the proximal area, typically exterior of the mounting surface to which the light fixture is secured. Additionally, however, the cover structure is preferably disposed substantially exterior of the mounting surface at which light fixture assembly is secured, and provides the attractive aesthetic exterior appearance that accentuates the illumination source. Also, the cover structure is also formed at least partially of a heat conductive material such as, but not limited to, a metallic material or other heat conductive material. When in an assembled orientation, the cover structure is operatively disposed preferably in direct confronting, contacting and/or mating engagement with the mounting assembly, but at a minimum in heat conductive relation to the illumination assembly so that heat is transferred thereto. It is therefore emphasized that the cover structure and possibly part of the mounting assembly, defines at least a portion of a heat sink and a path of thermal flow along which excessive heat may travel so as to be dissipated into the surrounding area.

In at least one preferred embodiment of the present invention, the cover structure has a larger transverse and substantially overall dimension than that of the mounting assembly in order to provide structural and decorative versatility to the formation of the light fixture assembly. In addition, the larger dimensioning as well as the cooperative configuring of the cover assembly further facilitates an efficient dissipation of an adequate amount of heat from the LED array of the illumination assembly, such that the illumination assembly may be operated under optimal conditions without excessive heat build-up.

In order to further facilitate the transfer of heat to the surrounding environment, correspondingly disposed surfaces of the mounting assembly and the cover structure may be disposed in continuous confronting engagement with one another over substantially all or at least a majority of the corresponding surface area of the mounting assembly, including by having all or part thereof being integrally formed with one another. Regardless, a substantial portion of the cover structure is disposed substantially exposed to the area being illuminated by the illumination assembly, the enlarged exterior surface area thus able to dissipate heat via radiation from the illumination assembly. For example, it the case of a recess mounted light fixture, rather than having to rely solely on conductivity via a large cumbersome, contained heat sink, the cover structure is able to utilize all of its exposed surface area to radiate heat, as it is not trapped behind the fixture in a wall surface, and an increase in heat dissipation is achievable by increasing the surface area of the cover structure and therefore the amount of radiation that can be achieved. Moreover, although not required for effective radiation of heat, by being exterior of the mounting structure and/or at least exposed to the area being illuminated, the cover structure and therefore the heat sink, has more access to air movement which can also help to dissipate heat from the fixture.

These and other features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 3:
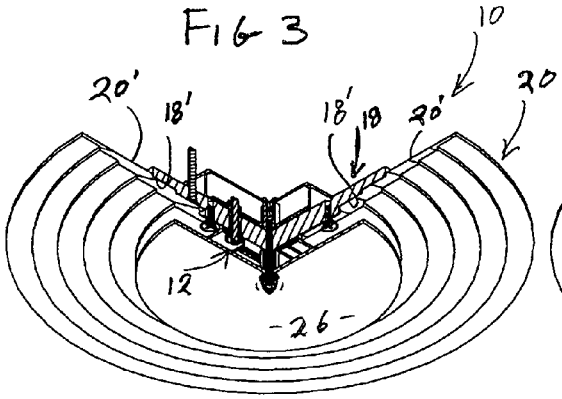
FIG. 3 is a bottom perspective view in partial cutaway showing details of the embodiment of FIGS. 1 and 2.

As shown in the accompanying drawings, the present invention is directed to a light fixture generally indicated as 10. The light fixture 10 is of the type which may be installed in any of a variety of commercial, domestic or other sites and is decorative as well as functional to effectively illuminate a given area or space in the vicinity of the installed location. More specifically, and with reference primarily to FIGS. 1 through 6, the light fixture assembly 10 includes an illumination assembly generally indicated as 12 comprising one or more light emitting diodes 14 connected to electrical control circuitry 16. The control circuitry 16 is preferably in the form of a printed circuit structure 16' or printed circuit board having the various electrical or circuitry components integrated therein.

In addition, the light fixture assembly 10 includes a mounting assembly generally indicated as 18 and preferably, but not necessarily, comprising a plate or disk like configuration as also represented. It is emphasized that the specific structural configuration and dimension of the mounting assembly 18 may vary from that other than the represented plate or disk like shape. However, the mounting assembly 18 is connected in supporting relation to the illumination assembly 12 such that the control circuitry 16, is disposed in direct confronting and heat transferring engagement with a corresponding portion of the mounting assembly 18 as clearly represented in FIGS. 5 and 8 through 10. Additional structural features of the mounting assembly 18 are its preferred formation from a conductive material. As such, the mounting assembly 18 may be formed from a metallic or other material which facilitates the conductivity or transfer of heat. As expected and discussed in greater detail hereinafter, the conductive material of the mounting assembly 18 will also be typically be electrically conductive. Such confronting engagement between the illumination assembly 12 and the mounting assembly 18 serves to adequately support and position the illumination assembly 12 in its intended orientation substantially co-axial to the mounting assembly 18 and also facilitates the transfer and dissipation of heat from the illumination assembly to and throughout the mounting assembly 18.

In order to enhance and render most efficient, the heat dissipating capabilities of the light fixture assembly 10, it further includes a cover structure generally indicated as 20 connected directly to the mounting assembly 18. More specifically, the cover structure 20 is also formed of a conductive material and as such is capable of heat transfer throughout its structure. In at least one preferred embodiment, the cover structure 20 is formed of a heat conductive material which may be a metallic material which is also capable of being electrically conductive. Therefore, efficient heat transfer from the illumination assembly 12 to the mounting assembly 18 and therefrom to the cover structure 20 is facilitated by the continuous confronting engagement of correspondingly positioned surfaces 18' and 20' respectively.

Heat dissipation is further facilitated by the structuring of the cover structure 20 to have an overall larger dimension than that of the mounting assembly 18. As such, the relatively unexposed surface 20' of the cover structure 20 is disposed in substantially continuous confronting engagement with the correspondingly disposed surface 18' to facilitate heat transfer through the mounting assembly 18 and the cover structure 20 when interconnected into the assembled orientation of FIGS. 1 through 3. Further, the correspondingly positioned surfaces 18' and 20' may also be correspondingly configured to further facilitate the continuous confronting engagement therebetween by establishing a mating relation as best demonstrated in FIG. 3.

Therefore, the corresponding configurations of the surfaces 18' and 20' may, in at least one preferred embodiment, be defined by a substantially "stepped configuration". Such a stepped configuration includes each of the confronting surfaces 18' and 20' having a plurality of substantially annular steps, as represented throughout FIGS. 1 through 10. More specifically, with reference to FIGS. 5 and 6, the mounting assembly 18 includes a plurality of annularly shaped steps 18" which collectively define the confronting surface 18' disposed in continuous engagement with the under surface or relatively unexposed surface 20' of the cover structure 20. The stepped configuration of the surface 20' of the cover structure 20 is clearly represented in FIG. 3 as is the mating relation or engagement between the annular steps 20" and 18" as indicated. As should also be noted, the plurality of annular steps 20" continue on the exposed or outer surface of the cover structure 20 in order to provide a more decorative or aesthetic appearance.

Figure 11:
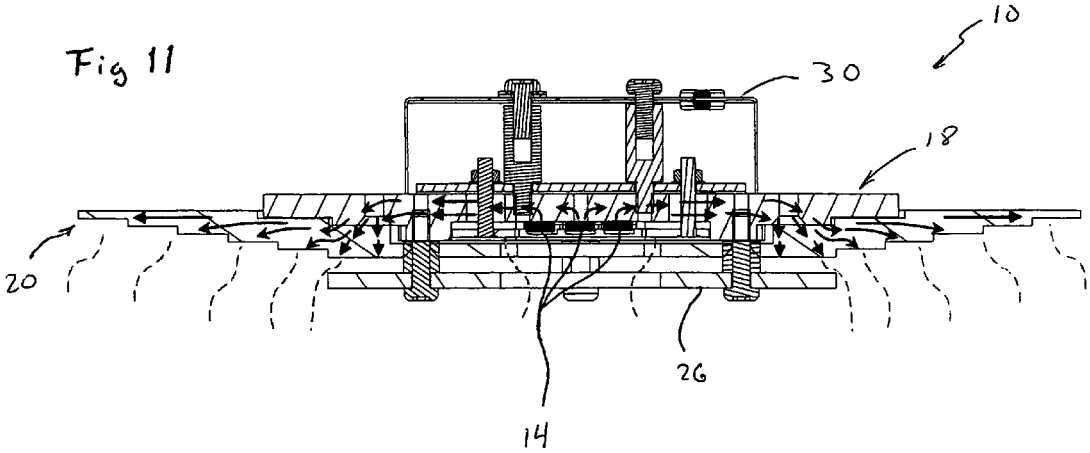
FIG. 11 is a perspective illustration of the cover structure illustrating heat radiation from the illumination assembly.

Looking to the embodiment of FIG. 11, it is recognized that all or part of the mounting assembly 18 may be integrally formed with the cover structure 20. In that regard, heat transferring conductivity is established between the illumination assembly and the cover structure 20, preferably, but not necessarily via the mounting assembly 18.

Due to the fact that the cover structure 20 extends outwardly some distance from the illumination assembly, but further because the enlarged exterior surface area of the cover structure 30 is disposed substantially exposed to an area being illuminated by said illumination assembly 12, such as exterior of the mounting surface at which the light fixture assembly 10 is mounted, either on or in, further facilitates the dissipation of heat being transferred from the illumination assembly 12. More specifically and as should be apparent, the heat being removed from the illumination assembly 12 is transferred there from to the cover structure 20, and there from is radiated to the surrounding environment. As noted, the cover structure 20 of the present invention, by being exposed to the surrounding environment instead of being contained within or behind a mounting surface, is able to take advantage of the exposed surface area to radiate the heat away and continuously pull more heat from the illumination assembly 12. In that regard, the heat dissipating qualities are virtually limitless, even if the opening or socket into which the light fixture is to be disposed or mounted has been pre-defined, because the heat sink is located outside of the mounting surface as part of the ornamental components of the fixture and can thus be increased in size and surface area to increase the power capacity and the light output that can be achieved by the lighting fixture 10.

By way of example, in the case of an LED or LED array illumination assembly 12, in one preferred embodiment, the surface area of the cover structure 20 may be at least approximately 32 inches for each square inch of light emitting surface. Alternately, the surface area of the cover structure 20 can be at least approximately 0.34 square inches per die having a lumen efficiency of less than 56% and/or at least 0.24 square inches per die having a lumen efficiency of less than 81%. In terms of power, in one preferred embodiment, the cover structure 20 can have a surface area of at least about 1.5 square inches, or in another embodiment at least about 2 square inches, per watt consumed by said illumination assembly 12. As a result, any additional heat generated by an increase in the illumination capabilities of the illumination assembly 12 can be addressed by an increase in the surface area of the cover structure, which as mentioned, can take on any of a variety of attractive and decorative appearances so long as at least a portion thereof maintains the heat radiating capabilities to the area being illuminated. Further, as still an added benefit to maximize the heat radiating characteristics of the cover structure 20, in another embodiment the exterior surface of the cover structure 20 may be anodized and/or powder coated. By way of example, the powder coating can be achieved utilizing an epoxy, polyurethane or equivalent material. It should be noted that in most embodiments, although the radiated heat is substantial in terms of the operational requirements of the illuminations assembly, due in part to the large surface area of the cover structure 20, the amount of heat will generally not be sufficient to elevate a room temperature and/or create a burning hazard.

Cooperative structural features of the illumination assembly 12, the mounting assembly 18, and the cover structure 20 include an apertured construction comprising the provision of an aperture or opening 24 in a center or other appropriate portion of the cover structure 20. The opening 24 is disposed, dimensioned and configured to receive the illumination assembly 12 therein or at least be in alignment therewith. As such, the light generated by the one or more light emitting diodes 14 pass through the opening 24 so as to be directed or channeled outwardly from the exposed or outermost surface of the cover assembly 20. The surrounding area is thereby effectively illuminated.

Additional structural features associated with the directing or channeling of light from the illumination assembly 12 through the opening 24 include a light shield 26 which may be formed of a transparent and/or translucent material such as glass, plastic, etc. The light shield 26 may be structured to further direct or channel, in a more efficient manner, the illumination generated by the LEDs 14 of the illumination assembly 12. Accordingly, the light shield 26 is disposed in overlying but spaced relation to the opening 24 and to the illumination assembly 12 when the various components of the light fixture assembly 10 are in an assembled orientation as represented in FIGS. 3 and 4.

Figure 4:
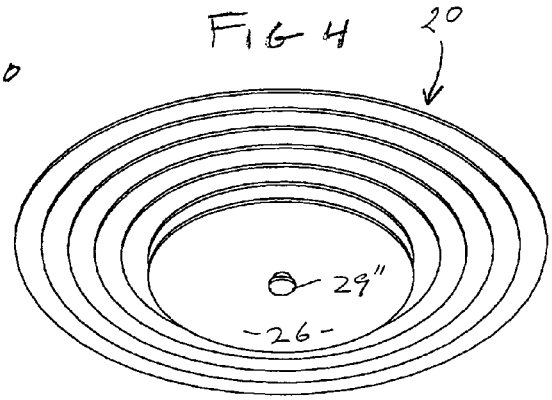
FIG. 4 is a bottom perspective view of the embodiment of FIGS. 1 through 3.
Figure 1:
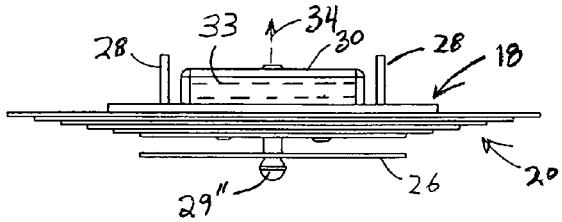
FIG. 1 is a side view of a preferred embodiment of a light fixture assembly of the present invention in an assembled form.
Figure 2:
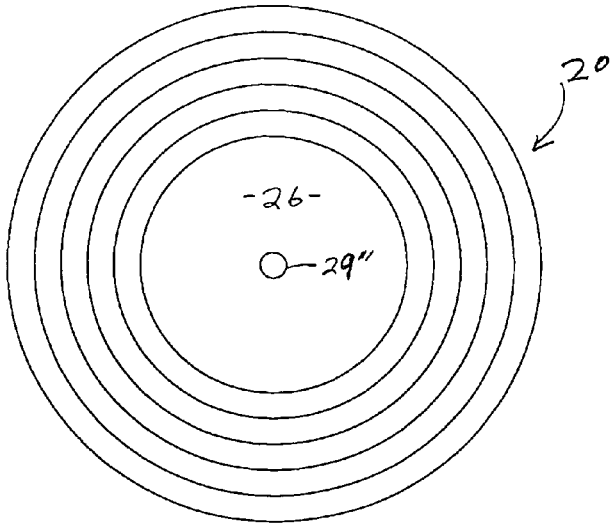
FIG. 2 is a bottom view of the preferred embodiment of FIG. 1.
Figure 5:
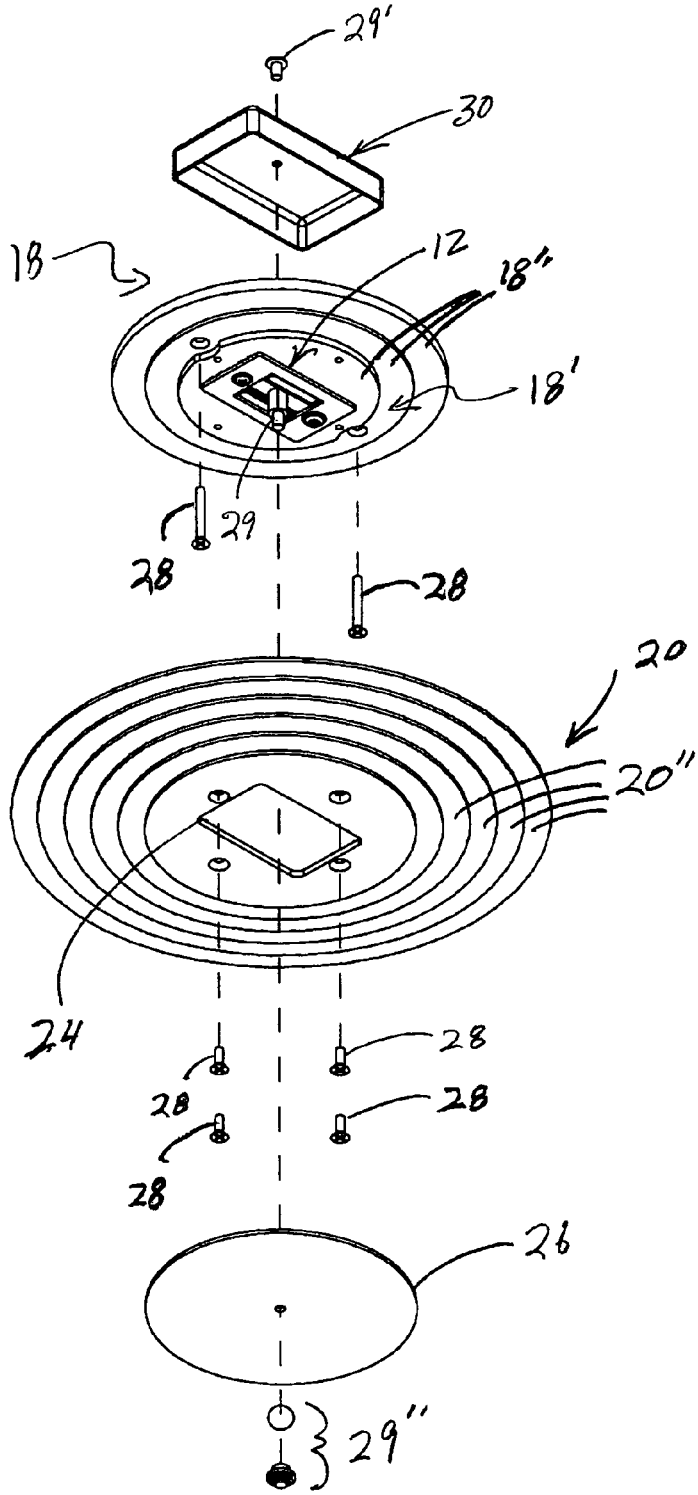
FIG. 5 is an exploded perspective view of the various operative and structural components associated with the embodiments of FIGS. 1 through 4.

Interconnection of the various components into the assembled orientation of FIGS. 3 and 4 may be accomplished by a plurality of generally conventional connectors as at 28 and a decorative or utilitarian attachment assembly 29, 29', 29", etc. Further, a housing, enclosure, junction box or like structure 30 is provided for the housing of wiring, conductors and other electrical components. Housing 30 is connected to the under surface or rear portion of the mounting assembly 18 and may further include supportive backing plates or the like as at 32 and 32'. These backing plates 32, 32' facilitate the interconnection and support of a remainder of the light fixture assembly 10 when it is attached to or supported by ceiling, wall or other supporting surface or structure. Moreover, as schematically represented in FIG. 1, the electrical components or conductors stored within the housing or junction box 30 are schematically represented as at 33. Further, an electrical interconnection to an appropriate source of electrical energy is also schematically represented as at 34 in FIGS. 1, 7 and 9.

Yet another preferred embodiment of the light fixture assembly 10 of the present invention is represented primarily but not exclusively in FIGS. 6 through 10. As set forth above with regard to the detail description of the structural features associated with FIGS. 1 through 5, the heat sink structure which facilitates the dissipation of heat from the illumination assembly 12 is defined, at least in part, by the mounting assembly 18 being disposed in heat transferring relation with the illumination assembly 12 and the cover structure 20 being disposed in substantially continuous, confronting engagement with the mounting assembly 18 along the correspondingly positioned surfaces 18' and 20'. As such, heat is transferred from the illumination assembly 12 through the mounting assembly 18 and to the cover structure 20 for eventual dissipation to the surrounding area. In accomplishing such an efficient heat transfer, both the mounting assembly 18 and the cover structure 20 are formed of a conductive material such as, but not limited to, a metallic material. The metallic material of which the mounting assembly 18 and the cover structure 20 are formed are also typically capable of conducting electrical current. Therefore, the additional preferred embodiment of FIGS. 6 through 10 is directed towards structural features which eliminate or significantly reduce the possibility of any type of electrical conductor or electrical components coming into direct contact with the mounting assembly 18 and/or the cover structure 20.

Figure 9:
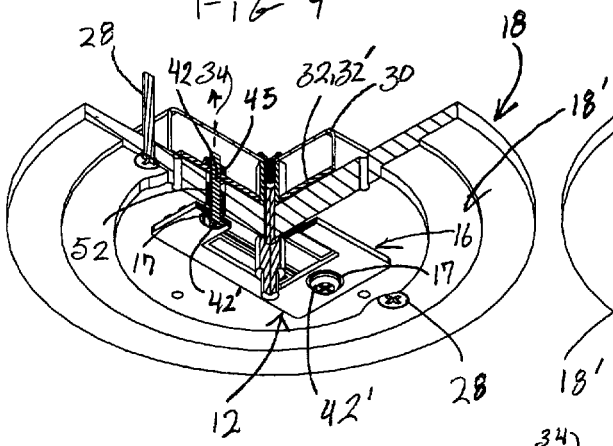
FIG. 9 is a bottom perspective view in partial cutaway showing details of the embodiment of FIGS. 6 through 8.
Figure 10:
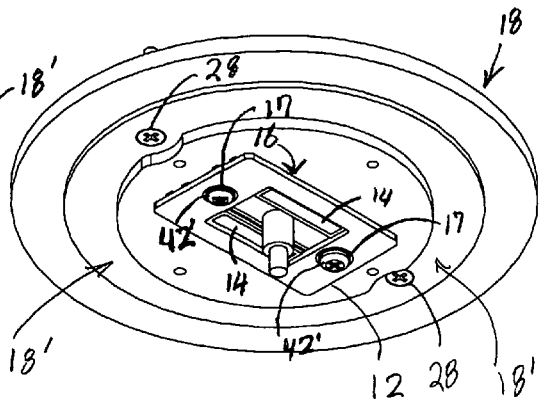
FIG. 10 is a bottom perspective view of the embodiment of FIGS. 6 through 9.

However, it is important that current flow is effectively directed to the illumination assembly 12 specifically including the control circuitry 16 to regulate the activation and operation of the one or more light emitting diodes 14. Therefore, the light fixture assembly 10 further includes a conductor assembly generally indicated as 40 in FIG. 6, which is disposed in interconnecting, current conducting relation between the illumination assembly 12 and an appropriate source of electrical energy as schematically represented in FIGS. 1, 7 and 9 as 34.

More specifically, the conductor assembly 40 is more specifically defined as at least one, but more practically a plurality of connectors 42. Each of the one or more connectors 42 is in the form of sufficiently dimensioned and configured connector structure formed of a conductive material. Moreover the one or more connectors 42 are disposed in mechanically interconnecting relation between the illumination assembly 12 and the mounting assembly 18. As such, when the one or more connectors 42 are in their interconnected disposition, as represented in FIGS. 7 through 10, they will mechanically connect the illumination assembly 12, and more specifically the printed circuit structure 16 with the mounting assembly 18. This interconnection may be accurately referred to as an "assembled orientation". Accordingly, the one or more conductive material connectors 42, when interconnecting the printed circuit structure 16' of the illumination assembly 12 to and/or with the mounting assembly 18, will establish a path of electrical current flow from the source of electrical energy 34, to the control circuitry 16 and the one or more LEDs 14. As such, appropriately disposed and structured conductors interconnect the one or more connectors 42 with the source of electrical energy 34. However, the specific wiring configurations which serve to interconnect the source of electrical energy 34 and the conductive material connectors 42 may take many forms and is therefore not shown, for purposes of clarity.

In addition, each of the one or more connectors 42 defining at least a part of the conductor assembly 40 are also specifically structured, such as about the head portions 42' thereof. These head portions 42' engage a conductive portion 17 of the printed circuit structure 16' such that electrical current flow will pass effectively through the control circuitry 16 to the one or more LEDs 14 in order to regulate and control activation and operation of the LEDs 14, as set forth above. Interconnecting disposition of the one or more connectors 42 with the illumination assembly 12 and the mounting assembly 18 is accomplished by the one or more connectors 42 passing through the body of the mounting assembly 18 by virtue of appropriately disposed and dimensioned apertures 44 formed in the mounting assembly 18. Securement of the connectors 42 in their interconnecting position, which defines the assembled orientation of the illumination assembly 12 of the mounting assembly 18, is further facilitated by the provision of connecting nuts or like cooperative connecting members 45 secured to a free end of the one or more connectors 42 represented in FIGS. 6 and 9.

As described, the one or more connectors 42, being formed of a conductive material, serve to establish an electrical connection and an efficient electrical current flow from the source of electrical energy 34 to the printed circuit structure 16' of the control circuitry 16. However, due to the fact that the mounting assembly 18 is also formed of a conductive material such as, but not limited to a metallic material, it is important that the one or more connectors 42 will be electrically isolated or segregated from contact with the mounting assembly 18 as they pass through the corresponding apertures 44 in the mounting assembly 18. Accordingly, this preferred embodiment of the light fixture assembly 10 of the present invention further comprises an insulation assembly 50. The insulation assembly 50 is formed of a non-conductive material and is disposed in isolating, segregating position between the one or more connectors 42 and the mounting assembly 18.

Figure 6:
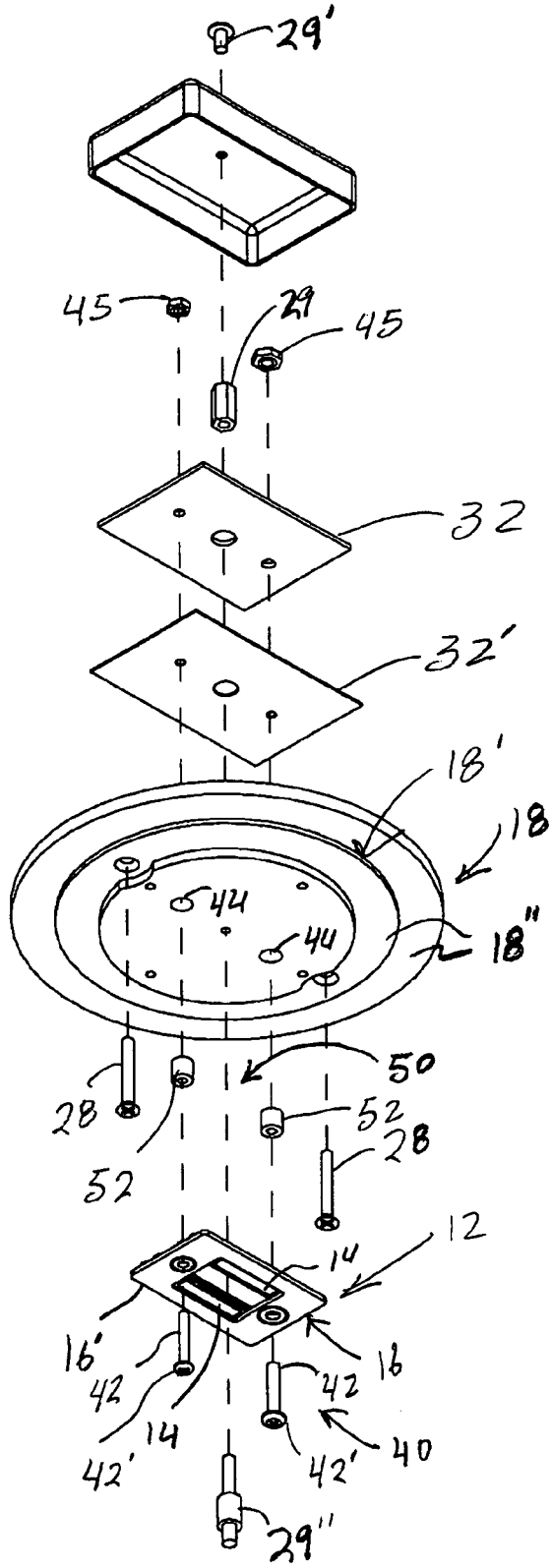
FIG. 6 is an exploded perspective view of a portion of the embodiments of FIGS. 1 through 5.
Figure 7:
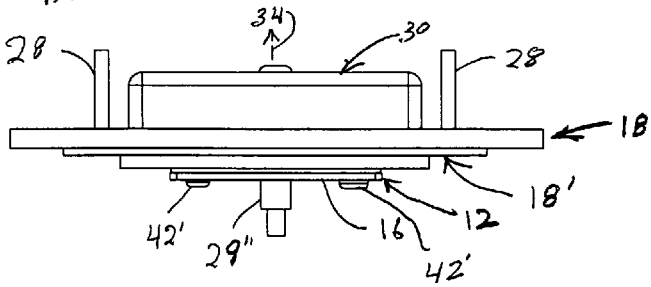
FIG. 7 is a side view of the embodiment of FIG. 6.
Figure 8:
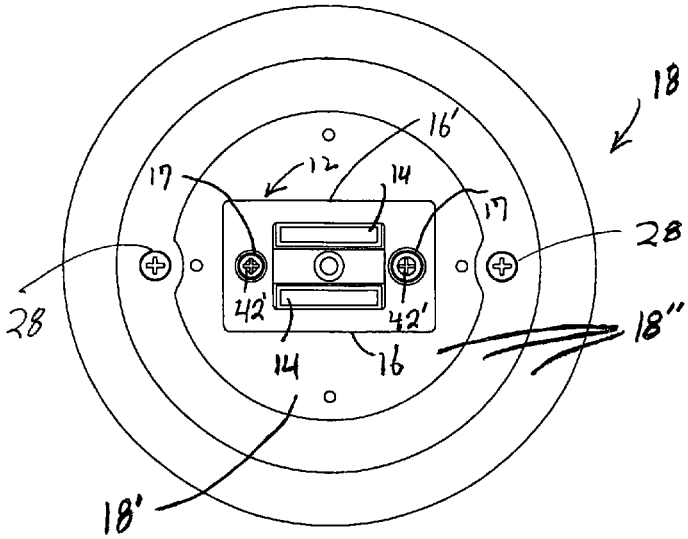
FIG. 8 is a bottom view of the embodiment of FIGS. 6 and 7.

With primary reference to FIGS. 6 and 9, the insulation assembly 50 comprises at least one but more practically a plurality of non-conductive material bushings 52 at least in equal in number to the number of conductive material connectors 42. Therefore, when the illumination assembly 12 and the mounting assembly 18 are in the assembled orientation as represented in FIGS. 7 through 10, the non-conductive material bushings 52 are connected to or mounted on the mounting assembly 18 by being disposed at least partially on the interior of the apertures 44. As such, the bushings 52 are disposed in surrounding, isolating, segregating relation to the conductive material connectors 42 so as to prevent contact between the connectors 42 and the mounting assembly 18. Therefore, because the bushings 52 effectively isolate or segregate each of the one or more connectors 42 from direct contact with the mounting assembly 18, any type of short-circuit will be eliminated or significantly reduced.

Therefore, the light fixture assembly 10 comprising both the aforementioned conductor assembly 40 and the cooperatively disposed and structured insulation assembly 50 facilitates the mounting assembly being disposed, when in the assembled orientation of FIGS. 7 through 10, in electrically isolated or segregated relation to the conductor assembly 40. Concurrently, the mounting assembly 18 is still disposed in heat dissipating relation to the illumination assembly 12 and the cover structure 20, wherein efficient removal or transfer of heat from the illumination assembly 12 is further facilitated, as described in detail above.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A light fixture assembly having heat dissipating capabilities, said light fixture assembly comprising:

an illumination assembly, a mounting assembly formed of heat conductive material and disposed in supporting, heat transferring engagement with said illumination assembly, a cover structure, said cover structure at least partially formed of a heat conductive material and connected in heat transferring engagement with said mounting assembly and in heat transferring relation to said illumination assembly, said cover structure including an enlarged exterior surface area exposed to an area being illuminated by said illumination assembly, said heat conductive material of each of said cover structure and said mounting assembly being sufficiently heat conductive to collectively define a heat sink, said enlarged exterior surface area having a greater transverse dimension than said mounting assembly and extending radially outward from said mounting assembly and said illumination assembly, and said enlarged exterior surface area disposed to radiate heat outwardly from said mounting assembly and said illumination assembly.

2. A light fixture assembly as recited in claim 1 wherein said mounting assembly is at least partially integrally formed with said cover structure.

3. A light fixture assembly as recited in claim 2 wherein said mounting assembly comprises an enclosure structured to contain portions of said illumination assembly, said enclosure being at least partially recessed within a mounting surface.

4. A light fixture assembly as recited in claim 1 wherein a surface area of said cover structure is at least 32 square inches per square inch of light emitting surface.

5. A light fixture assembly as recited in claim 1 wherein said illumination assembly comprises at least one LED.

6. A light fixture assembly as recited in claim 5 wherein a surface area of said cover structure is at least 0.34 square inches per die having a lumen efficiency of less than 56%.

7. A light fixture assembly as recited in claim 5 wherein a surface area of said cover structure is at least 0.24 square inches per die having a lumen efficiency of less than 81%.

8. A light fixture assembly as recited in claim 1 wherein a surface area of said cover structure is at least 1.5 square inches per watt consumed by said illumination assembly.

9. A light fixture assembly as recited in claim 1 wherein a surface area of said cover structure is at least 2 square inches per watt consumed by said illumination assembly.

10. A light fixture assembly as recited in claim 1 wherein said enlarged surface area of said cover structure includes a stepped configuration.

11. A light fixture assembly as recited in claim 1 wherein said enlarged surface area of said cover structure comprises an anodized exterior surface structured to maximize heat radiating characteristics of said cover structure.

12. A light fixture assembly as recited in claim 1 wherein said enlarged surface area of said cover structure comprises a powder coated exterior surface structured to maximize heat radiating characteristics of said cover structure.

13. A light fixture assembly as recited in claim 12 wherein said enlarged surface area of said cover structure further comprises an anodized exterior surface structured to maximize heat radiating characteristics of said cover structure.

14. A recessed light fixture, said light fixture comprising:

an LED light source, a mounting assembly formed of heat conductive material and connected in supporting engagement with said LED light source, said mounting assembly at least partially recessed within a mounting surface, a cover structure, said cover structure formed of a heat conductive material and connected in heat transferring engagement with said mounting assembly and in heat transferring relation to said LED light source, said conductive material of each of said cover structure and said mounting assembly being sufficiently heat conductive to collectively define a heat sink for said LED light source, said cover structure including an enlarged decorative exterior surface having a greater transverse dimension that said mounting assembly, said enlarged decorative exterior surface being disposed exteriorly of the mounting surface and structured to radiate heat outwardly, away from the mounting surface, said mounting assembly and said LED light source.

15. A light fixture assembly as recited in claim 14 wherein said enlarged decorative exterior surface is anodized and powder coated so as to maximize heat dissipating characteristics of said cover structure.

* * * * *